US010912706B2

(12) United States Patent
Raab et al.

(10) Patent No.: US 10,912,706 B2
(45) Date of Patent: Feb. 9, 2021

(54) BODILY INSERTION DEVICE WITH TAIL ATTACHMENT

(71) Applicants: Joshua Raab, Royal Oak, MI (US); Alma Raab, Royal Oak, MI (US)

(72) Inventors: Joshua Raab, Royal Oak, MI (US); Alma Raab, Royal Oak, MI (US)

( * ) Notice: Subject to any disclaimer, the term of this patent is extended or adjusted under 35 U.S.C. 154(b) by 133 days.

(21) Appl. No.: 15/859,814

(22) Filed: Jan. 2, 2018

(65) Prior Publication Data

US 2019/0201279 A1 Jul. 4, 2019

(51) Int. Cl.

| | |
|---|---|
| ***A61H 21/00*** | (2006.01) |
| ***A61H 19/00*** | (2006.01) |
| ***A61H 1/00*** | (2006.01) |

(52) U.S. Cl.

CPC ..... *A61H 21/00* (2013.01); *A61H 1/00* (2013.01); *A61H 19/44* (2013.01); *A61H 2201/165* (2013.01); *A61H 2205/087* (2013.01)

(58) Field of Classification Search

CPC .. A61H 19/00; A61H 19/40–50; A61H 21/00; A61H 2201/165–1652; A61H 2205/085–087

See application file for complete search history.

(56) References Cited

U.S. PATENT DOCUMENTS

2011/0270033 A1 11/2011 Jackson
2012/0201599 A1* 8/2012 Reppen ..... F16G 15/06 403/348
2017/0087049 A1 3/2017 Hutchison

OTHER PUBLICATIONS

Vuzara; https://www.etsy.com/uk/shop/Vuzara; selling this product https://www.etsy.com/listing/519750840/tail-butt-plug-bdsm-butt-plug-dildo-tail at least as of Jun. 14, 2017; also found on Vuzara's Facebook page at least as of Sep. 12, 2017. (Year: 2017).*

Foxxymamas (https://twitter.com/foxxymamas1/status/826496149741826048?lang=en; https://twitter.com/Foxxymamas1/status/778686197195415552) (Year: 2017).*

"/diy/ Do-It-Yourself" forum, made public on Mar. 27, 2014, URL: https://warosu.org/diy/thread/617447.

"The Ultimate Guide to Anal Plug Play," made public on Jun. 17, 2017, URL: https://couplesplaythings.com/blogs/articles/the-ultimate-guide-to-anal-plug-play-1.

* cited by examiner

*Primary Examiner* — Thaddeus B Cox

(74) *Attorney, Agent, or Firm* — Carlson, Gaskey & Olds, P.C.

(57) ABSTRACT

An example tail assembly includes a bodily insertion device that extends along a longitudinal axis from a base to a tip. A shackle is secured to the base and includes a pair of spaced apart arms. The example tail assembly also includes a tail having an eyelet, and a rod inserted into respective openings in the spaced apart arms. The rod is inserted through the eyelet between the respective openings, thereby securing the tail to the bodily insertion device.

8 Claims, 4 Drawing Sheets

BODILY INSERTION DEVICE WITH TAIL ATTACHMENT

BACKGROUND

This application relates to a bodily insertion device having a tail attachment.

The furry subculture is interested in fictional anthropomorphic animal characters with human personalities and characteristics. Practitioners of this subculture are known to wear full body costumes of animals such as wolves, foxes, dogs, and cats for role-play. Some practitioners like to wear full or partial costumes in an intimate setting.

SUMMARY

An example tail assembly includes a bodily insertion device that extends along a longitudinal axis from a base to a tip. A shackle is secured to the base and includes a pair of spaced apart arms. The example tail assembly also includes a tail having an eyelet, and a rod inserted into respective openings in the spaced apart arms. The rod is inserted through the eyelet between the respective openings, thereby securing the tail to the bodily insertion device.

An example method of securing a tail to a bodily insertion device includes inserting a rod through an eyelet of a tail, and mounting the rod to a shackle that is secured to a base of a bodily insertion device. The mounting is performed such that the rod extends between a pair of spaced apart arms of the shackle, and passes through the eyelet of the tail between the pair of spaced apart arms, thereby securing the tail to the shackle and the bodily insertion device.

The embodiments, examples, and alternatives of the preceding paragraphs, the claims, or the following description and drawings, including any of their various aspects or respective individual features, may be taken independently or in any combination. Features described in connection with one embodiment are applicable to all embodiments, unless such features are incompatible.

DETAILED DESCRIPTION

Figure 1:
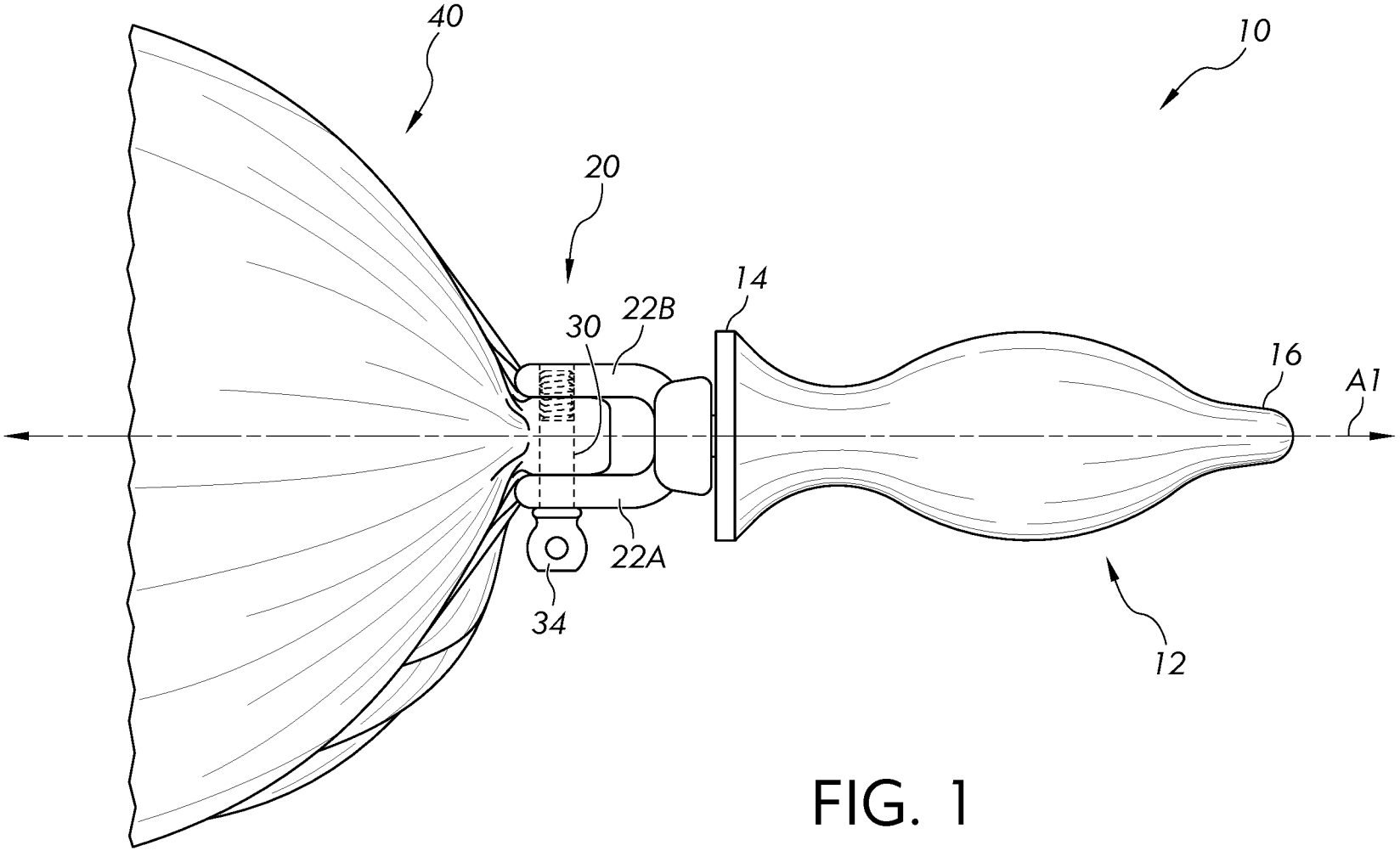
FIG. 1 illustrates an example tail assembly.

FIG. 1 is a schematic view of an example tail assembly 10. The tail assembly 10 includes a bodily insertion device 12 that extends along a longitudinal axis A1 from a base 14 to a tip 16. A generally U-shaped shackle 20 is secured to the base 14 and includes a pair of spaced apart arms 22A-B. A rod 30 is inserted into openings in the spaced apart arms 22A-B (see FIG. 2), and is inserted through an eyelet of a tail 40 (see, e.g., FIG. 6) between the pair of spaced apart arms 22A-B, thereby securing the tail 40 to the bodily insertion device 12. The tail 40 may be a real or synthetic tail, for example.

Figure 2:
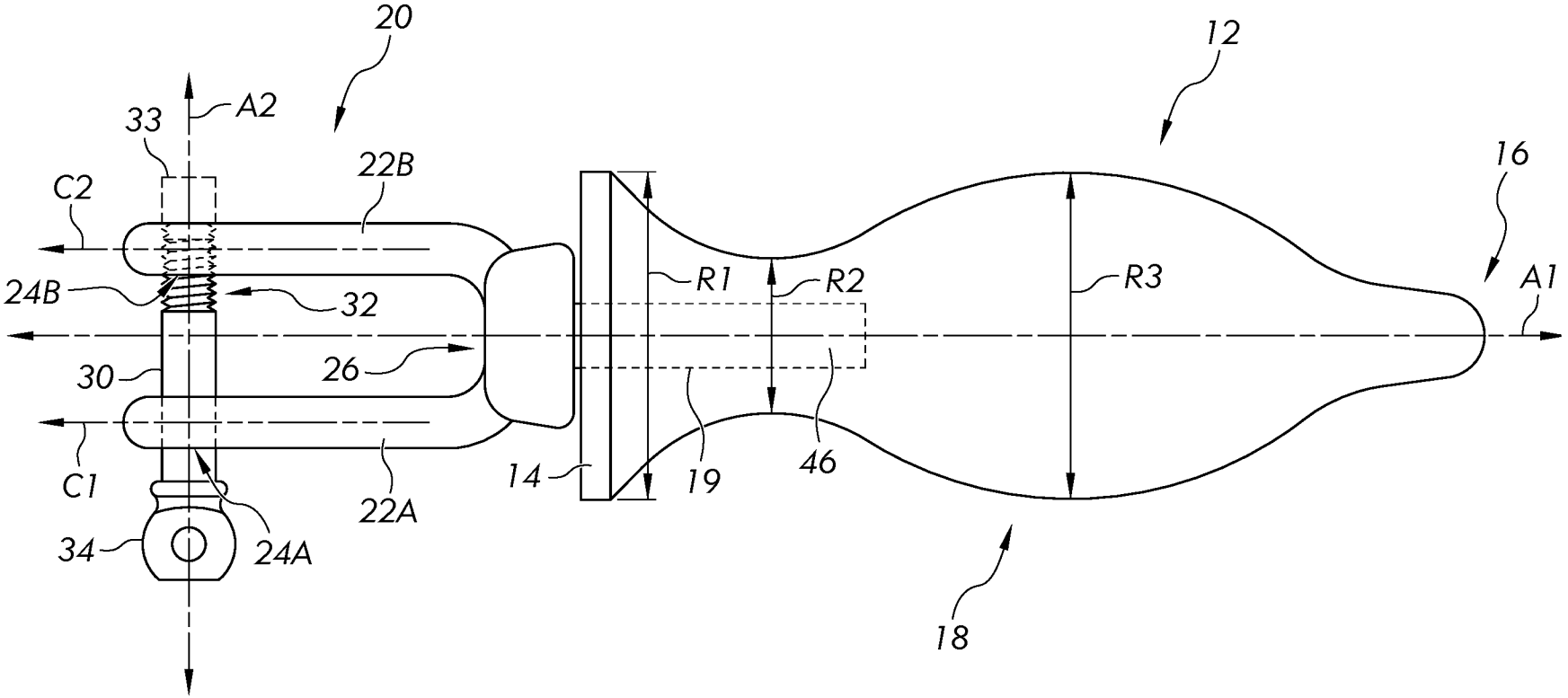
FIG. 2 illustrates an enlarged view of a shackle and bodily insertion device of FIG. 1.

FIG. 2 illustrates an enlarged view of the shackle 20 and bodily insertion device 12 of FIG. 1. In the examples of FIGS. 1-2, the bodily insertion device 12 is an anal plug that includes the base 14 having a radius R1, a neck 17 having a radius R2, and a body 18 having a radius R3. The radius R2 is less than radius R1 and radius R3. When the body 18 is inserted into a user's rectum, the base 14 remains outside of the user and may serve as a perineal contact surface for the user. Although a particular bodily insertion device 12 is shown in FIG. 2, it is understood that devices having other profiles could be used (e.g., a device having a more conical profile in the body 18, or a vaginal insertion device).

The rod 30 is inserted into respective openings 24A, 24B in the arms 22A-B. In one example, the rod 30 is inserted through opening 24A, then through an eyelet in the tail 40, and then into the opening 24B, and an inner surface of the opening 24B is threaded to engage threads 32 of the rod 30. In another example, the rod 30 extends all the way through the second arm 22B and fastens to a nut 33 that is outside of the pair of arms 22A-B. FIG. 2 depicts an example nut 33 that abuts the arm 22B and the opening 24B. These are non-limiting examples, and other mounting configurations could be used, such as a cotter pin that extends through the rod 30 and prevents removal of the rod from the opening 24B, for example.

In a fastened position, the rod 30 extends along longitudinal rod axis A2. The axis A2 is perpendicular, or generally perpendicular (e.g., an angle of 85°-100° angle) to the axis A1. In the example of FIG. 2, the arms 22A-B extend along centerlines C1, C2 that are generally parallel to the longitudinal axis A1.

In the example of FIGS. 1-2, the rod 30 includes a head 34 at one end that serves as a gripping surface for rotating the rod within the openings 24A-B.

The bodily insertion device 12 includes a cavity 19 that extends from the base 14 into the bodily insertion device 12 towards the tip 16. In the example of FIG. 2, the cavity 19 is collinear with the longitudinal axis A1. In other examples, the cavity 19 is offset or oblique with respect to the longitudinal axis A1.

The pair of spaced apart arms 22A-B extend from a shackle body 26 that joins the arms 22A-B together. A threaded fastener 46 engages threads of the cavity 19 to fasten the shackle body 26 to the cavity 19. In one example, the threaded fastener 46 passes through the shackle body 26 along axis A1. In another example, the threaded fastener 46 is integral with the shackle body 26 and does not extend all the way through the shackle body 26.

In this disclosure, like reference numerals designate like elements where appropriate and reference numerals with the addition of one-hundred or multiples thereof designate modified elements that are understood to incorporate the same features and benefits of the corresponding elements.

Figure 3:
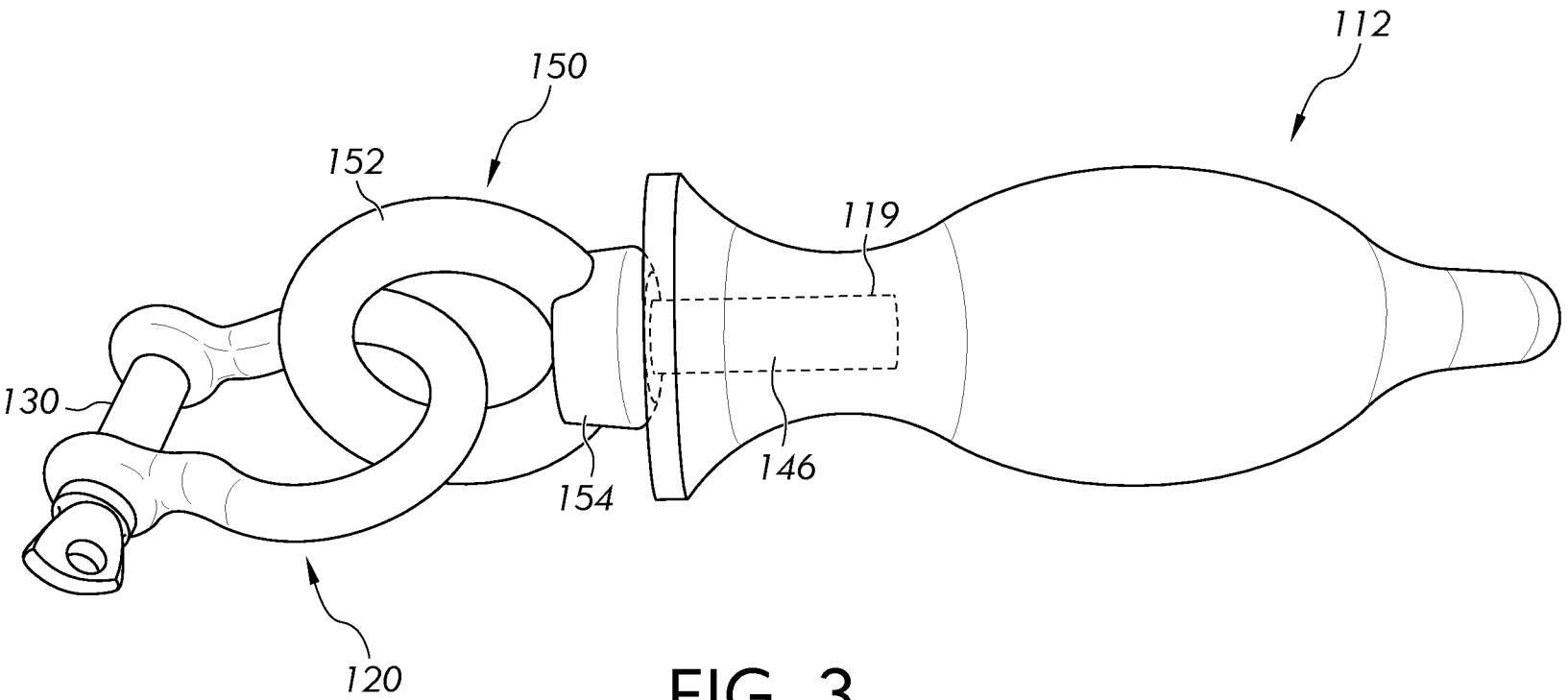
FIG. 3 illustrates another example shackle.

FIG. 3 illustrates an example embodiment in which a ring 150 secures a shackle 120 to an insertion device 112. The ring 150 includes a circular portion 152 and a ring platform 154. The ring platform 154 is mounted a cavity 119 of the bodily insertion device 120. A threaded fastener 146 extends from the ring platform 154 into the cavity 119 and engages threads in the inner cavity to mount the ring 150 to the bodily insertion device 112. The threaded fastener 146 may extend all the way through the ring 150 or may be integral with the ring 150, for example.

Shackle 120 extends through the ring 150, such that when rod 130 is fastened in the shackle 120, the ring 150 and shackle 120 are linked to each other and to the bodily insertion device 112.

Figure 4:
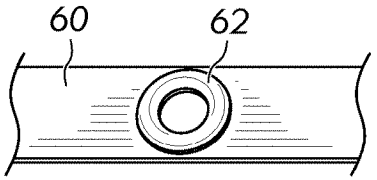
FIG. 4 illustrate an example grommet strap.

FIG. 4 illustrate an example grommet strap 60 that includes a grommet 62 embedded in the grommet strap 60 and providing a passage that extends through the grommet strap 60.

Figure 5:
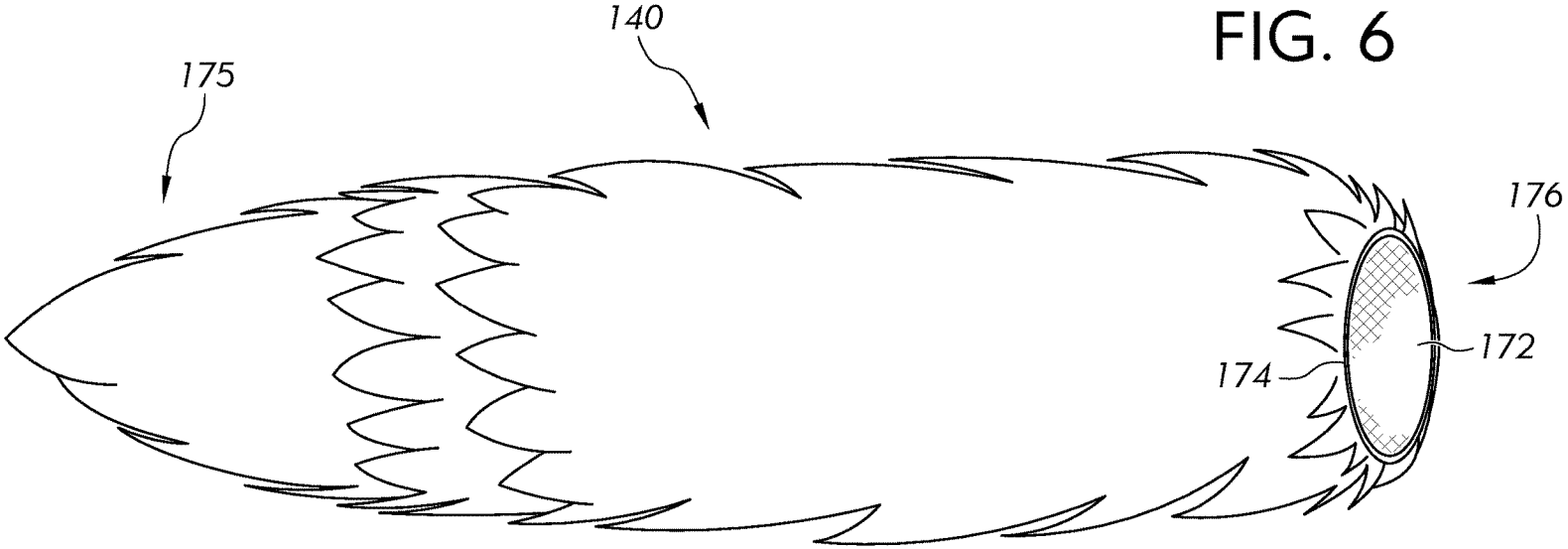
FIG. 5 schematically illustrates an example synthetic tail.

FIG. 5 schematically illustrates an example synthetic tail 140 prior to attachment of the grommet 62. The synthetic tail has a first end 175 that is closed and an opposing second end 176 that is open. The synthetic tail 140 is generally cylindrical and includes a central passage 172 that extends between the two ends 175, 176. At the second end 176, the synthetic tail 140 includes a rim 174 at the second end 176. In one example, the rim 174 is an outer face of the end 176.

Figure 6:
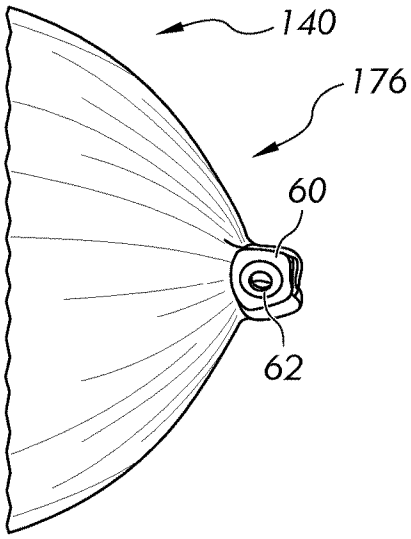
FIG. 6 illustrates an example tail that utilizes the grommet strap of FIG. 4.

FIG. 6 illustrates an example in which the grommet strap 60 is stitched to the rim 174 of the tail 140 to situate the grommet 62 as an eyelet at the end 176 of the tail 140 through which rod 30, 130 can extend. This provides for a high degree of strength and prevents removal of the tail 140 from the grommet 62 even if the grommet 62 and tail 140 are pulled in opposite directions.

In one example one, or more of the bodily insertion device 12, 112; shackle 30, 130; ring 150, and grommet 62 are at least partially composed of metal, such as stainless steel.

The various embodiments discussed above provide a number of benefits, including a strong and durable connection between the tail 40 and bodily insertion device 12, minimizing the possibility that the tail 40 becomes inadvertently removed from the bodily insertion device 12. Also, the tail assembly 10 provides for convenient removal of the tail 40 from the bodily insertion device 12 for separate cleaning of the tail 40 and/or insertion device 12 and/or for wearing the tail 40 in a public setting without the bodily insertion device 12.

Unlike prior art tails which relied on a glued connection, the tail assembly 10 provides a connection between the tail and bodily insertion device 12 that can be quickly and easily detached and reattached. Also, while the prior art glued connection was prone to inadvertent detachment, the mechanical coupling between the tail 40 and bodily insertion device 12 in the tail assembly 10 is far stronger and can allow for significant pulling on the tail while the bodily insertion device 12 is stationary or is being pulled in an opposite direction without detaching the tail 40.

Although example embodiments have been disclosed, a worker of ordinary skill in this art would recognize that certain modifications would come within the scope of this disclosure. For that reason, the following claims should be studied to determine the scope and content of this disclosure.

What is claimed is:

1. A tail assembly comprising:

a bodily insertion device that extends along a longitudinal axis from a base to a tip;

a shackle secured to the base and comprising a pair of spaced apart arms;

a tail comprising an eyelet; and a rod inserted into respective openings in the spaced apart arms, and inserted through the eyelet between the respective openings, thereby securing the tail to the bodily insertion device.

2. The tail assembly of claim 1, wherein the rod comprises threads that engage threads in one of the respective openings, or engage a threaded nut that is outside of the pair of spaced apart arms.

3. The tail assembly of claim 1, wherein the rod is generally perpendicular to the longitudinal axis when inserted into the respective openings in the spaced apart arms.

4. The tail assembly of claim 1:

wherein the bodily insertion device comprises a cavity that extends from the base into the bodily insertion device towards the tip; and wherein the shackle comprises a shackle body that joins the pair of spaced apart arms together, and a fastener extending from the shackle body into the cavity and mounting the shackle to the bodily insertion device.

5. The tail assembly of claim 4, wherein the fastener and cavity are collinear with the longitudinal axis when the fastener extends into the cavity.

6. The tail assembly of claim 1:

wherein the bodily insertion device comprises a cavity that extends from the base into the bodily insertion device towards the tip; and wherein the tail assembly comprises a ring having a fastener that is mounted within the cavity, the shackle extending through the ring, thereby securing the shackle to the base.

7. The tail assembly of claim 1, wherein a diameter of the bodily insertion device tapers between the base and the tip in a neck region.

8. A tail assembly comprising:

a bodily insertion device that extends along a longitudinal axis from a base to a tip;

a shackle secured to the base and comprising a pair of spaced apart arms;

a tail comprising an eyelet; and a rod inserted into respective openings in the spaced apart arms, and inserted through the eyelet between the respective openings, thereby securing the tail to the bodily insertion device;

wherein the eyelet comprises a grommet that provides a passage through a grommet strap, and the grommet strap is sewn to an end of the tail.

* * * * *